United States Patent [19]

Banik

[11] Patent Number: 5,009,704

[45] Date of Patent: Apr. 23, 1991

[54] PROCESSING NICKEL-BASE SUPERALLOY POWDERS FOR IMPROVED THERMOMECHANICAL WORKING

[75] Inventor: Anthony Banik, Mesa, Ariz.

[73] Assignee: Allied-Signal Inc., Morristownship, N.J.

[21] Appl. No.: 373,354

[22] Filed: Jun. 28, 1989

[51] Int. Cl.[5] ..... C22C 29/04

[52] U.S. Cl. ..... 75/238; 75/241; 75/244; 75/246; 419/12; 419/16; 419/28; 419/29; 419/39; 419/49; 419/54; 419/60

[58] Field of Search ..... 419/28, 29, 12, 15, 419/39, 49, 54, 60; 75/246, 241, 238, 244

[56] References Cited

U.S. PATENT DOCUMENTS

| | | | |
|---|---|---|---|
| 3,420,716 | 1/1969 | Slepitis | 148/11.5 |
| 3,671,230 | 6/1972 | Smythe et al. | 75/213 |
| 3,698,962 | 10/1972 | Kasak et al. | 148/11.5 |
| 3,702,791 | 11/1972 | Freche et al. | 148/11.5 |
| 3,704,508 | 12/1972 | Di Giambattista | 29/420.5 |
| 3,802,938 | 4/1974 | Collins et al. | 148/126 |
| 3,850,702 | 11/1974 | Buchanan | 148/11.5 |
| 3,888,663 | 6/1975 | Reichman | 75/221 |
| 4,081,295 | 3/1978 | Vogel | 148/11.5 |
| 4,110,131 | 8/1978 | Gessinger | 148/11.5 |
| 4,591,482 | 5/1986 | Nyce | 419/38 |

OTHER PUBLICATIONS

"Superplasticity in P/M In-100 Alloy", Journal of Powder Metallurgy 6(1) 1970, pp. 65-75.

"Sintering of Inconel 718" Internl. Journal of Powder Metallurgy, vol. 16, No. 3, 1980 pp. 255-266.

"Homogenization of VIM-VAL Inconel Alloy 718", J. M. Poole Special Melting and Processing Technologies, Vacuum Metallurgy Proceedings, Apr. 1988, pp. 508-540.

*Primary Examiner*—Stephen J. Lechert, Jr.
*Assistant Examiner*—Nina Bhat
*Attorney, Agent, or Firm*—Robert A. Walsh; James W. McFarland

[57] ABSTRACT

A nickel-based superalloy article formed from particles of the superalloy is processed to have a microstructure which is resistant to failure when processed using high strain thermomechanical processes. Articles having the desired microstrucuture are produced by hot isostatically pressing powder of the superalloy in a specified temperature range bounded by the incipient melting temperature as a minimum and the solvus temperature of stable high temperature phases. The compact is held under pressure in the specified temperature range to diffuse deleterious phases which exist as a result of the initial powder atomization operation. The powder compact thus formed can be processed using conventional processes to produce material for subsequent thermomechanical processing using high strain rate forging equipment and retain the benefits of chemical uniformity and cleanliness associated with traditional powder metal processes.

8 Claims, 1 Drawing Sheet

PROCESSING NICKEL-BASE SUPERALLOY POWDERS FOR IMPROVED THERMOMECHANICAL WORKING

TECHNICAL FIELD

This invention relates to metallurgical alloys and their processing, and, more particularly, to the thermomechanical processing of nickel-based superalloy powders.

BACKGROUND OF THE INVENTION

In an aircraft jet engine, air is drawn into the engine and compressed by a compressor. The compressed air is mixed with jet fuel, and the mixture is ignited and burned. The burning exhaust gases are directed against a series of turbine blades mounted on a large wheel called a turbine wheel or turbine disk, causing the turbine disk to turn. The disk is mounted on a shaft, which also supports the compressor, and the turning of the turbine disk thereby turns the compressor to maintain the continuous operation of the engine.

The materials used to manufacture turbine blades and turbine disks must be capable of operation at very high temperatures, in the neighborhood of 2000° F., under high stress and fatigue loadings, and in adverse corrosive environments produced by the combustion gas. One of the primary areas of improvement of jet engines lies in raising their operating temperature to achieve higher thermodynamic efficiencies. The materials used in turbine blades and disks are pushed to the limits of their capabilities by these increases in operating temperature.

Thus, the search for higher performance, more fuel efficient jet engines is closely linked with the development of better materials for use in turbine blades and turbine disks. In its presently most significant embodiment, the current invention deals with a method of improved manufacturing of components to meet ever more demanding requirements in jet engines and other applications that require high performance from superalloys.

One of the families of metallurgical alloys is the nickel-based superalloys, which are used extensively as the materials of construction of turbine blades and disks. These alloys have excellent properties at elevated temperatures, and are presently used in most turbine blade and turbine disk applications. Although many different types have been developed, one important class of nickel-based superalloys have a number of carefully chosen alloying elements added to a nickel base. When examined under a microscope, these alloys have a structure comprising particles of $Ni_3(Al,Ti)$, called gamma prime particles, in a matrix of grains of a nickel alloy, termed a gamma matrix.

The relative amounts and structure of the gamma prime particles and gamma matrix, the properties of these two phases, and the microstructure of the superalloy, determine the performance of the nickel-based superalloy, which in turn is the limiting factor in the ability of the turbine disk made of the alloy to operate at high temperatures. Increasing amounts of the gamma prime particles tend to give the alloy greater strength, but also make the mechanical working of the alloy to form a turbine disk more difficult. Another important consideration is the grain size of the matrix. Microstructural inhomogeneities tend to reduce the workability of the alloy, and also reduce its ability to tolerate small cracks or other imperfections in the material. Turbine disks typically fail due to small defects caused by fatigue or monotonic loadings, and it is desirable that the turbine disks be able to resist failure due to such defects when they occur. Increased grain size and reduced microstructural inhomogeneity can contribute to overall turbine disk performance.

Thus, the attainment of high performance, and the ability to fabricate high performance alloys into usable structures such as turbine disks are dual considerations in the selection of alloys and manufacturing techniques for turbine disks. In the past, turbine disks were manufactured by casting the alloy to shape, or casting and working the alloy to the final shape. One important improvement has been the development of powder metallurgical techniques for fabricating turbine disks, wherein the article is formed from a powder or particles of the superalloy, consolidated, and worked to a final shape. Furnishing the alloy as a powder or particles reduces the degree of microstructural inhomogeneity typical of prior ingot casting techniques.

However, there are several new problems which arise when working with metal powders. One significant problem relevant to the present invention is the lack of ductility in the consolidated powder preform. For a more complete discussion of this and other problems, see U.S. Pat. Nos. 3,698,962 and 3,702,791. The prior art has tried to solve this problem in several ways. Processes for filling and consolidating metal powders are well known in the art. Kasak et al, in U.S. Pat. No. 3,698,962 described a method for hot isostatic pressing powders to eliminate or significantly reduce entrapped porosity. In addition, several methods for cleaning the powder surface have been proposed by utilizing various acid washing techniques such as that described by in U.S. Pat. No. 3,704,508. Powder surface cleaning techniques using a reducing gas to clean the powder after can filling is described in U.S. Pat. No. 4,693,863 from Carpenter Technology Corp.

The foregoing processing techniques utilize an external media, either liquid or gas, to remove or enhance the powder surface to improve diffusion during consolidation. In doing so, introduction of the "cleansing" media increases the potential risk of introducing a potential reactive defect to the powder metal. Therefore in order to minimize the effects of powder contaminants, the present art for consolidating nickel superalloy powders consists of isostatically pressing the powder at a temperature below the solidus temperature or hot compacting the powder and extruding the compact before final forging to the desired configuration. The compacted powder metal material produced in such a manner is sensitive to high forging strain rates in excess of 5 in-/in/min. and, therefore, is forged on specialized low strain rate equipment.

It should be apparent from the foregoing that there is a continuing need for a processing technology to fabricate high performance nickel-based superalloys into parts, such as turbine disks, with a microstructure that is conducive to achieving excellent performance in the finished part. While heretofore described in terms of turbine disks for the sake of clarity, such a process would yield important benefits in the fabrication of other parts from superalloys. The present invention fulfills this need for an improved processing technology, and further provides related advantages.

SUMMARY OF THE INVENTION

The present invention provides a process for preparing articles from nickel-based superalloy powders which results in: an increased resistance to fracture during thermomechanical processing, a reduction in microsegregation formed during powder atomization, and improved resistance to powder contaminants which can cause premature fatigue failures.

The process, when utilized as part of an ingot conversion sequence, can be applied to produce both fine and coarse grain microstructures required for high strength and fatigue resistance or creep and defect tolerance, respectively. It has been found that the application of the present invention allows significantly higher strain rates (in excess of 360 in/in/min.) to be utilized with conventional forging equipment without increasing the potential for powder metal contamination, so that large capital outlays are not required. The process is compatible with a wide range of superalloy compositions.

In accordance with the invention, a process for preparing a consolidated nickel-based superalloy article comprises the steps of furnishing superalloy powder of known composition; hot isostatically pressing the superalloy powder within a specified elevated temperature range to produce a partial liquid film at the powder particle surface to disperse detrimental phases (but below a temperature at which there is excessive solutioning of stable metal carbides) slowly cooling the compact to a temperature below the solidus and holding for a time sufficient to diffuse alloying elements which have segregated to the liquid at the elevated temperature before cooling to room temperature. After cooling, the compact can be processed using conventional high strain rate deformation routes, such as forging or extrusion, to produce the necessary microstructures for the final application.

The starting material for the processing is a prealloyed powder made of the superalloy material. Such powders are available commercially from several sources and for a number of different superalloys. The powders may be prepared by any acceptable technique, such as gas or plasma atomization or melt spinning.

In one approach, the powders are produced using a gas atomization practice. As the liquid metal droplet solidifies in an inert environment, lower melting compounds, such as metal complexes containing boron and carbon, solidify at the powder surface. The powders are subsequently collected, classified and loaded into a metal container. In this form, there are spaces between the powder particles, as the particles do not fit together perfectly. Moreover, the powder particles are not chemically bonded together. The metal container is evacuated by vacuum pump and sealed off with an interior vacuum.

After loading into the powder container, the powder is consolidated under pressure at a temperature above the incipient melting temperature to solutionize complex boride and carbide compounds but below the temperature at which the more stable metal carbide (MC) phase is solutioned. The consolidation parameters will be somewhat dependent on the alloy chemistry and will typically be in the range of about 25° to 50° F. above the solidus temperature and at a pressure of about 15,000 psi for about three hours. Consolidation temperatures above the solutioning temperature for the MC phase would result in an excess of precipitates on cooling which can be deleterious to the final application of the material.

The compact should be cooled to a temperature which is below the solidus temperature (typically about 50° to 75° F. above the gamma prime solvus and held for a period of time of approximately 4 hours. At the initial high temperature consolidation some alloy elements selectively diffuse to the liquid phase. The consolidated billet is held at a temperature below the incipient melting temperature to homogenize alloying elements which may have segregated to the liquid. After holding below the incipient melting point, the consolidation can be cooled to room temperature.

The second homogenization cycle to eliminate microsegregation can, as an alternative, be performed as a separate step using conventional heat treating equipment or as an interim step prior to subsequent deformation.

When the consolidation and homogenization operations are complete, the material can be hot or warm worked to provide the necessary microstructures for the final component. Since the complex boride and carbide phases which can restrict grain growth have been dispersed, coarse grain microstructures can be achieved by direct extrusion at temperatures at about 25° F. above the gamma prime solvus temperature. Alternatively, fine grain microstructures can be achieved by working the material below the gamma prime solvus temperature.

Those skilled in the art of thermomechanical processing have restricted the strain rate utilized in forging components produced from conventionally processed powder metal material. It is understood that the strain rate for conventional material must be maintained below approximately 5 in/in/min. to prevent catastrophic fracturing of the material which would render the component unusable or requiring extensive additional processing. Powder metal material processed using the novel process described can be forged to the finish part shape on high production forging equipment using strain rates in excess of 360 in/in/min. thus eliminating the high burden costs of specialized forging equipment such as isothermal and hot die processes and the associated reduced production rates.

It will be appreciated that the present invention represents an important advance in the art of processing nickel-base superalloys into usable articles. Other features and advantages of the invention will be apparent from the following more detailed description, taken in conjunction with the accompanying figures, which illustrate, by way of example, the principles of the invention.

BEST MODE FOR CARRYING OUT THE INVENTION

In the presently preferred embodiment, the present invention is used to process the nickel-based superalloy UDIMET 720, a commercially available superalloy having a typical composition as set forth in the following Table I.

TABLE I

| Element | Chemical Analysis (Weight %) |
|---|---|
| Carbon | 0.03 |
| Manganese | 0.01 |
| Silicon | 0.01 |
| Chromium | 18.32 |
| Cobalt | 14.42 |
| Iron | 0.34 |
| Molybdenum | 3.10 |
| Tungsten | 1.27 |
| Titanium | 5.02 |
| Aluminum | 2.49 |
| Boron | 0.034 |
| Zirconium | 0.03 |
| Sulphur | 0.004 |
| Nickel | Balance |

The UDIMET 720 is purchased as a prealloyed powder from the Special Metals Corp., and is made by gas atomization. The powder used in the work discussed below has a sieve analysis of −270 mesh, although other sieve sizes would be acceptable.

A sample of U720 powder metal may be tested using a known method to determine the temperature of critical phase transformation. One such method, differential thermal analysis (DTA), detects the thermal energy emitted during a phase transformation. Using DTA techniques, the temperature at which incipient melting occurs within the powder metal is evident by a significant loss in thermal energy in the sample. In a similar manner, temperatures at which various phase transformations such as boride and carbide formation and gamma prime precipitation can be identified. In these nickel-base superalloys, incipient melting occurs at a lower temperature than that necessary to solutionize the more stable metal carbide (MC) phase.

Figure 1:
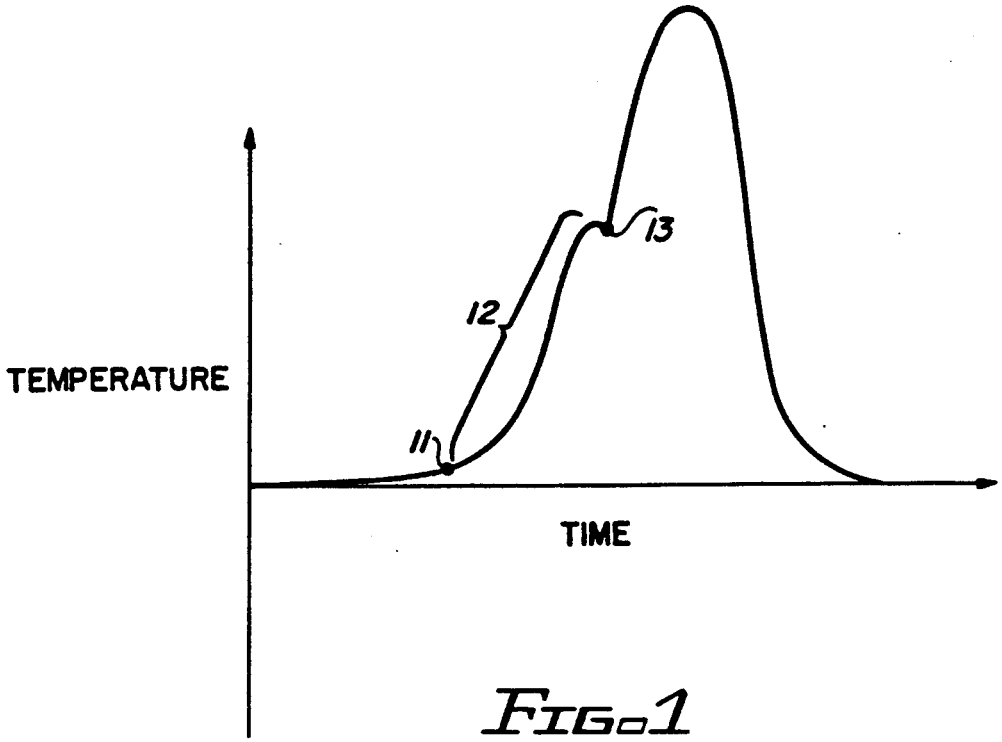
FIG. 1 is a graph of a differential thermal analysis curve for a typical superalloy illustrating the critical processing temperature range of the present invention.

FIG. 1 illustrates a DTA curve of U720 which indicates the solidus temperature 11, intermediate temperature 12 at which a small fraction of liquid phase is formed, and the temperature 13 at which the more stable carbides begin to dissolve.

The following tests illustrate certain aspects of the invention, but should not be taken as limiting of the invention in any respect.

EXAMPLE 1

Figure 2:
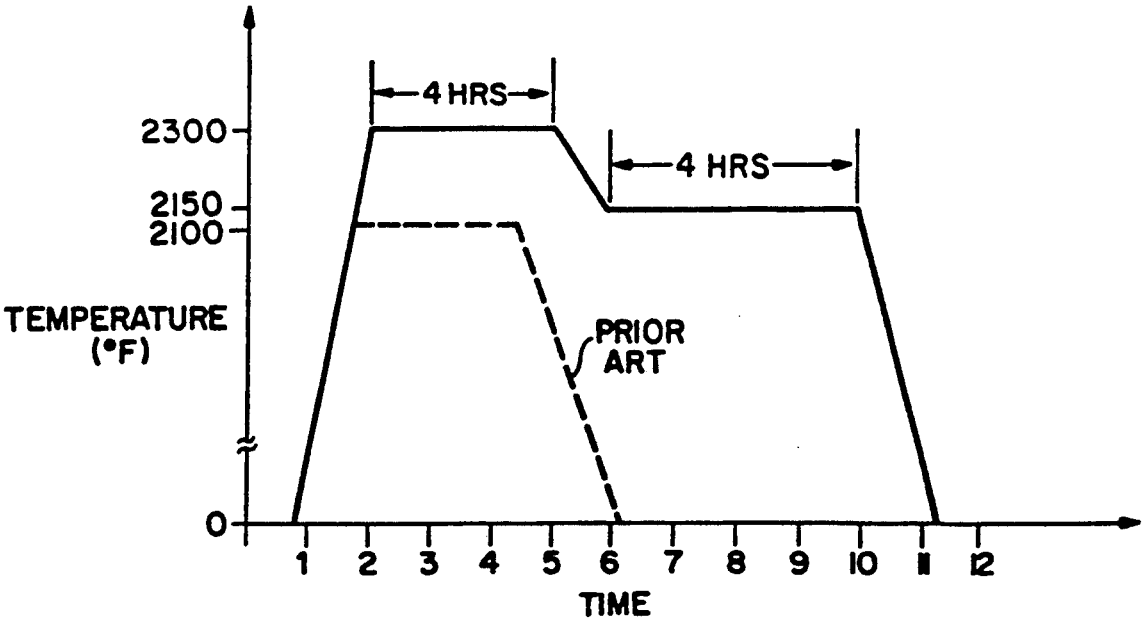
FIG. 2 is a graph representing the hot isostatic pressing thermal cycle of the present invention compared to the prior art cycle.

U720 powder was placed into a steel container, evacuated with a mechanical pump and sealed. The container was placed into a hot isostatic press and heated to a temperature of about 2300° F., and then isostatically pressurized at a pressure of about 15,000 pounds per square inch. After a time of about 3 hours, the temperature was decreased to about 2150° F. and held for another 4 hours after which the pressure was removed, and the consolidated powder (within the container) was slow cooled at a rate of about 200° F. per hour to a temperature below 800° F., and removed from the apparatus. This process is schematically illustrated in FIG. 2 in comparison to the prior art process.

EXAMPLE 2

Subscale powder metal compacts were produced as in Example 1 to evaluate the effects of various temperatures for isostatic pressing on the presence of the complex metal boride and carbide phases present at the powder surface after atomization. Analysis of the microstructure revealed that a significant reduction in the complex metal boride and carbide phases occur at a temperature above the incipient melting temperature and below the temperature where the more stable metal carbides fully solutionize. Above the temperature at which the more stable metal carbides fully solutionize, an increase in localized precipitates occur in the compact.

EXAMPLE 3

Two full scale powder metal compacts were produced using the above described practice. The sensitivity of the material to high strain rate deformation was evaluated on subscale test samples using a high strain rate laboratory test equipment. Eight test samples were evaluated at strain rates from 0.2 to 6 in/in/min. and temperatures from 1975° to 2075° F. No surface rupturing problems were evident after deformation.

EXAMPLE 4

One full scale compact was produced as in Example 1 for a production test. After cooling to room temperature the superalloy compact was placed into an extrusion container and reheated to a temperature of 2000° F. which is below the gamma prime solvus. The compact was extruded at an extrusion rate of 180 in/in/min. and an extrusion ratio of approximately 6:1 after heating to temperature.

The compact was machined and ultrasonic inspected prior to forging. Forging operations were performed on a high strain rate screw press at a temperature of 2050° F. with a starting strain rate of approximately 300 in/in/min. for a total reduction of approximately 75 percent. The final component was uniform and did not exhibit surface rupturing or cracking. Review of the microstructure of the component did not reveal any alloy segregation or banding indicating the chemical uniformity obtained by powder processing was maintained with the present invention.

From these examples, it is apparent that the material's sensitivity to high strain deformation processing has been significantly reduced or eliminated. Since the process has been applied in a production scale environment, it is concluded that the reduction in manufacturing costs associated with the conventional equipment and increased production rates can be readily achieved.

The present invention has been described in its preferred embodiment as applied to UDIMET 720. Other precipitation hardenable nickel-based superalloys may also be processed according to the invention, yielding improved results as compared with conventional processing.

Although a particular embodiment of the invention has been described in detail for purposes of illustration, various modifications may be made without departing from the spirit and scope of the invention. Accordingly, the invention is not to be limited except as by the appended claims.

What is claimed is:

1. A process for preparing a consolidated nickel-based superalloy compact which may be forged at high strain rates comprising the steps of:

introducing said superalloy powder of known composition into a container;

evacuating and sealing the container containing the powder under a vacuum;

hot isostatically pressing the container to form a consolidated compact at a first temperature, time and pressure, said first temperature being above the incipient melting temperature of the powder to solutionize complex boride and carbide compounds but below the temperature necessary to solutionize the stable metal carbide phase during said time and pressure;

heating the compact to a second temperature below the incipient melting temperature;

holding the compact at said second temperature for a second period of time to homogenize the compact; and cooling the compact to room temperature.

2. The process of claim 1 in which the superalloy powder is U720: the first temperature, time and pressure are about 2300° F., 3 hours, and 15,000 psia respectively; and the second temperature and time are about 2150° F. and 4 hours.

3. The process of claim 2 further including the step of forging the compact at a strain rate in excess of 300 in/in/min. without visible rupturing of the forged article.

4. The process of claim 2 wherein the step of cooling the compact to room temperature includes cooling at a rate of about 200° F. per hour to a temperature below about 800° F.

5. The process of claim 1 wherein the compact is allowed to cool after the hot isostatic pressing step and before the heating to and holding at a second temperature steps.

6. The process of claim 5 wherein the heating to and holding at a second temperature occurs immediately prior to hot forming the compact into a useful article.

7. A superalloy article prepared by the process of claim 3.

8. A process for forming a nickel-base superalloy article comprising the steps of: hot isostatically pressing powder of the superalloy at a temperature above its solidus to form some liquid phase complex boride and carbide compounds but below the temperature at which stable metal carbides are dissolved; cooling the hot pressed powder below its solidus and holding for a period of time necessary to diffuse alloying elements which have segregated into the liquid phase: then hot working the consolidated powder into a useful article at a high rate of strain.

* * * * *